US006543713B1

(12) United States Patent
Frolander et al.

(10) Patent No.: US 6,543,713 B1
(45) Date of Patent: Apr. 8, 2003

(54) WOVEN AND BARBED WIRE FENCE ROLLER APPARATUS

(76) Inventors: Robert J. Frolander, 19652 U.S. Hwy. 14, Sundance, WY (US) 82729; Michael R. Frolander, 19652 U.S. Hwy. 14, Sundance, WY (US) 82729

( * ) Notice: Subject to any disclaimer, the term of this patent is extended or adjusted under 35 U.S.C. 154(b) by 0 days.

(21) Appl. No.: 09/625,552

(22) Filed: Jul. 25, 2000

(51) Int. Cl.[7] ..... B65H 75/44

(52) U.S. Cl. ..... 242/399.1; 242/397.2; 242/397.5; 242/399.2; 242/403; 242/573.5; 242/557; 242/566

(58) Field of Search ..... 242/399.1, 403, 242/397.5, 397.2, 573.2, 573.5, 557, 566, 399.2

(56) References Cited

U.S. PATENT DOCUMENTS

| | | | | |
|---|---|---|---|---|
| 2,704,191 A | | 3/1955 | Schley et al. | 242/93 |
| 2,834,574 A | | 5/1958 | Sentman | 254/166 |
| 2,914,270 A | | 11/1959 | Parker et al. | 242/86.5 |
| 3,048,348 A | | 8/1962 | Griffin | 242/86.5 |
| 3,227,393 A | | 1/1966 | Misegadis | 242/86.5 |
| 3,346,213 A | * | 10/1967 | Nelson | 242/397.2 |
| 3,650,492 A | * | 3/1972 | Stum | 242/399.1 |
| 3,661,340 A | | 5/1972 | Trussell | 242/86.8 |
| 3,823,892 A | * | 7/1974 | Glaser | 242/573.2 |
| 4,469,288 A | * | 9/1984 | Pontes | 242/573.2 |
| 4,473,196 A | | 9/1984 | Sammann et al. | 242/86.5 |
| 5,246,182 A | | 9/1993 | Lester | 242/86.5 R |
| 5,385,314 A | | 1/1995 | Hughes | 242/397.3 |
| 5,683,057 A | * | 11/1997 | Gangemi | 242/573.2 |
| 5,806,779 A | | 9/1998 | Crum | 242/399.1 |

* cited by examiner

*Primary Examiner*—John Q. Nguyen
(74) *Attorney, Agent, or Firm*—Flanagan & Flanagan; John R. Flanagan

(57) ABSTRACT

A wire fence roller apparatus includes a framework, a rotatable elongated drum, a pair of guide plates, and a wire guiding arrangement. The drum is mounted to a pivotal end portion of the framework for undergoing pivotal movement therewith. The drum is thus swingable with the pivotal end portion of the framework toward and away from a stationary end portion of the framework so as to dispose the drum in an operative position wherein the drum extends between and is rotatably mounted to the opposite end portions of the framework to permit winding or unwinding of wire fence about or from the drum with rotation of the drum and in an inoperative position wherein the drum is released from and angularly displaced away from the stationary end portion of the framework to permit loading and unloading of the wire fence onto and from the drum. The guide plates are mounted to the drum and are spaced apart from one another along a longitudinal central axis of the drum so as to define a region on the drum between the guide plates about which the wire fence can be wound about or unwound from the outer surface of the drum. The wire guiding arrangement includes a support bracket rotatably mounted to the framework, a plurality of vertical rollers mounted upon the support bracket and spaced apart from one another so as to define spaces therebetween through which individual strands of barbed fence wire are guided to the drum, and an actuator connected between and to the framework and the support bracket and being extendible and retractable for moving the support bracket between a raised inoperative position and a lowered operative position relative to the drum.

11 Claims, 5 Drawing Sheets

WOVEN AND BARBED WIRE FENCE ROLLER APPARATUS

BACKGROUND OF THE INVENTION

1. Field of the Invention

The present invention generally relates to wire fence roller assemblies and, more particularly, is concerned with a woven and barbed wire fence roller apparatus.

2. Description of the Prior Art

Woven and barbed wire fences are used in a variety of situations and are being put up and taken down all the time. Such fences, however, are difficult to handle and laborious to install and remove. Machines are often employed for unwinding or winding these fences during the installation and removal processes. Various types of machines have been developed over the years for this purpose.

Representative examples of prior art wire fence roller assemblies and the like are disclosed in U.S. Pat. No. 2,704,191 to Schley et al., U.S. Pat. No. 2,834,574 to Sentman, U.S. Pat. No. 2,914,270 to Parker et al., U.S. Pat. No. 3,048,348 to Griffin, U.S. Pat. No. 3,227,393 to Misegadis, U.S. Pat. No. 3,661,340 to Trussell, U.S. Pat. No. 4,473,196 to Sammann et al., U.S. Pat. No. 5,246,182 to Lester, U.S. Pat. No. 5,385,314 to Hughes, U.S. Pat. No. 5,806,779 to Crum. While these and other prior art wire fence roller assemblies appear to be satisfactory in use for the specific purposes for which they were designed, many seem unduly complicated to operate and limited in their applications.

Consequently, a need remains for an apparatus which will provide a more effective solution to the aforementioned problem in the prior art without introducing any new problems in place thereof.

SUMMARY OF THE INVENTION

The present invention provides a woven and barbed wire fence roller apparatus designed to satisfy the aforementioned need. The wire fence roller apparatus of the present invention is relatively simple to operate and yet versatile in its applications. The wire fence roller apparatus can be employed with both woven and barbed wire fences.

Accordingly, the present invention is directed to a wire fence roller apparatus which comprises: (a) a framework adapted for mounting on a movable carrier; (b) an elongated drum having a pair of opposite ends, a longitudinal central axis extending between the opposite ends and an outer surface surrounding and spaced radially outwardly from the longitudinal central axis and extending between the opposite ends, the drum being securely and rotatably mounted at one of the opposite ends thereof to the framework and releasably and rotatably latched at the other of the opposite ends thereof to the framework; (c) means for causing rotation of the drum about the longitudinal central axis thereof for winding or unwinding wire fence about or from the outer surface of the drum; and (d) means for causing pivotal movement of the drum relative to the framework for disposing the drum in an operative position wherein the other opposite end of the drum is rotatably latched to the framework so as to permit rotation of the drum and winding or unwinding of the wire fence about or from the outer surface of the drum and for disposing the drum in an inoperative position wherein the other opposite end of the drum is released and angularly displaced away from the framework so as to permit loading and unloading of the wire fence onto and from the drum.

More particularly, the framework has a substantially U-shaped configuration. The framework includes a pair of support beams and a pair of end portions. Each of the support beams has a pair of opposite ends such that the support beams are interconnected at the same ones of their opposite ends to the movable carrier. One of the end portions is pivotally swingably mounted to the other of the opposite ends of one of the support beams whereas the other of the end portions is stationarily mounted to the other of the opposite ends of the other of the support beams and spaced laterally and opposite from the pivotally swingably mounted one of the end portions. The framework further includes a central pedestal for mounting the framework to the movable carrier. The support beams are fixedly attached at the same ones of the opposite ends thereof to and extend in generally opposite directions from the central pedestal.

The drum at the one of the opposite ends thereof is securely and rotatably mounted to the pivotal end portion of the framework for undergoing pivotal swinging movement therewith whereas the drum at the other of the opposite ends thereof is releasably and rotatably mounted to the stationary end portion of the framework. The drum is pivotally swingable with the pivotal end portion of the framework relative to the support beams of the framework and pivotally swingable toward and away from the stationary end portion of the framework so as to dispose the drum in the operative position wherein the drum extends between the opposite end portions of the framework and the other of the opposite ends of the drum is rotatably latched to the stationary end portion of the framework to permit rotation of the drum and winding or unwinding of the wire fence about or from the drum and in an inoperative position wherein the other of the opposite ends of the drum is released from the stationary end portion of the framework and angularly displaced away therefrom to permit loading and unloading of the wire fence onto and from the drum. The means for causing pivotal movement of the drum relative to the framework includes an actuator connected between and to the pivotal end portion of the framework and the one of the support beams of the framework. The actuator is extendible and retractable for pivotally swingably moving the pivotal end portion of the framework and the drum therewith between the operative position and the inoperative position. The means for causing rotation of the drum includes a motor mounted to the pivotal end portion of the framework and a drive train movably coupling the motor to the one end of the drum such that operation of the motor causes rotation of the drum.

The drum has a plurality of slots defined in the outer surface thereof being circumferentially spaced apart from one another and extending generally parallel to the longitudinal central axis of the drum between the opposite ends thereof. The apparatus further comprises a plurality of elongated bars mounted to the drum for undergoing radial movement toward and away from the longitudinal central axis of the drum through the slots in the outer surface of the drum between an extended position wherein outer edges of the bars are disposed outwardly from the outer surface of the drum such that the wire fence in being wounded about the outer surface of the drum is wound on the outer edges of the bars and thus spaced outwardly from the outer surface and a retracted position wherein the outer edges of the bars are disposed closer to the outer surface of the drum than when at the extended position such that the wire fence wound about the outer surface of the drum can be slidably removed from the other of the opposite ends of the drum. The apparatus further comprises means for causing radial movement of the bars relative to the drum between the extended and retracted positions. The radial movement causing means includes an externally threaded drive screw rotatably mounted to the drum and extending along the longitudinal central axis of the drum, an internally threaded cam collar disposed around and threadably engaged with the drive screw for undergoing movement therealong in opposite directions upon rotation of the drive screw in opposite directions, a plurality of cam followers each attached to one of the bars and engaged with the cam collar such that each of the bars is radially movable between the retracted and extended positions in response to rotation of the drive screw in one or the other of the opposite directions which causes movement of the cam collar in one or the other of opposite directions along the longitudinal central axis of the drum, means for biasing each of the bars to the retracted position, and means for causing rotation of the drive screw in the opposite directions.

The apparatus still further comprises a pair of guide plates mounted to the drum and spaced apart from one another along the longitudinal central axis of the drum so as to define a region on the drum between the guide plates at which the wire fence can be wound and unwound about the outer surface of the drum. The apparatus yet further comprises a wire guiding arrangement. The wire guiding arrangement includes a support bracket having forward and rearward members and opposite end members extending between and rigidly interconnecting the forward and rearward members and a plurality of vertical rollers mounted upon the forward member of the support bracket. The rearward member of the support bracket is rotatably mounted to the framework such that the opposite end members of the support bracket extend above and forwardly of the drum to the forward member of the support bracket. The vertical rollers are laterally spaced apart from one another so as to define spaces therebetween through which individual strands of barbed wire fence are guided to the drum. The wire guiding arrangement also includes an actuator connected between and to the framework and the rearward member of the support bracket and being extendible and retractable for moving the support bracket between a raised inoperative position and a lowered operative position.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
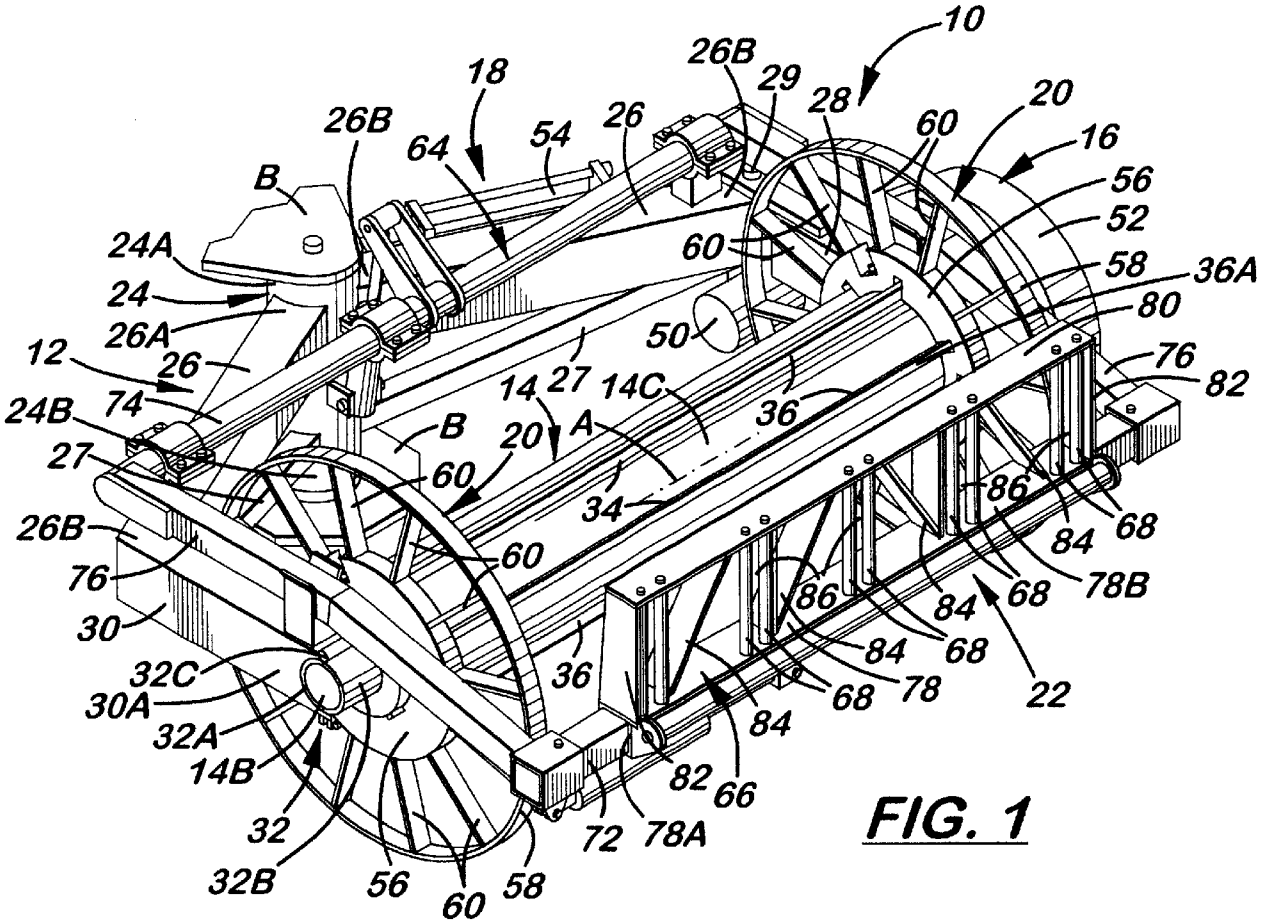
FIG. 1 is a perspective view of a woven and barbed wire fence roller apparatus of the present invention.

Referring to the drawings and particularly to FIGS. 1 and 3 to 5, there is illustrated a wire fence roller apparatus, generally designated 10, of the present invention. The wire fence roller apparatus 10 basically includes a framework 12, an elongated drum 14, a drum rotation means 16 and a drum pivotal movement means 18. The wire fence roller apparatus 10 also includes a pair of guide plates 20 and a wire guiding arrangement 22.

Figure 2:
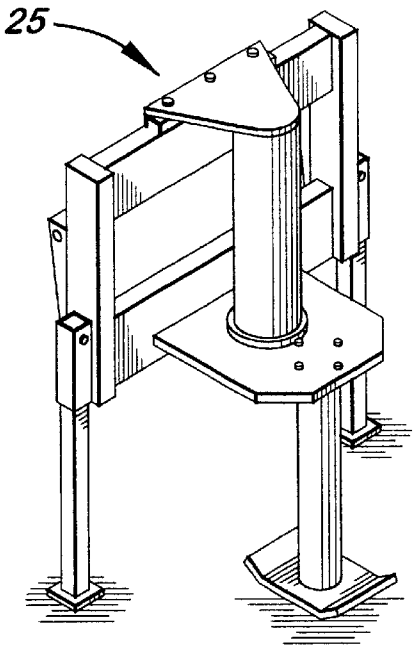
FIG. 2 is a perspective view of a support attachment for mounting the apparatus of FIG. 1.

The framework 12 is adapted for mounting on a movable carrier, such as an implement moved by a tractor (not shown). The framework 12 has a substantially U-shaped configuration and includes an upright central post or pedestal 24, a pair of rigid support beams 26 and a pair of rigid end portions 28, 30. The central, pedestal 24 has a substantially cylindrical configuration and opposite upper and lower ends 24A, 24B. The central pedestal 24 is adapted to be mounted to the movable carrier. For example, the central pedestal 24 of the framework 12 is disposed between and attached at its upper and lower ends 24A, 24B to upper and lower brackets B which are attached to and extend forwardly from a bucket (not shown) of a front end loader (not shown) mounted on the tractor. Alternatively, in FIG. 2 there is shown an adapter 25 which can be employed to interconnect the central pedestal 24 to forward ends of the lift arms (not shown) of the front end loader with the bucket removed.

Each of the support beams 26 of the framework 12 has a substantially rectangular transverse configuration and a pair of opposite ends 26A, 26B. Each support beam 26 is fixedly attached at an inner end 26A to and extends in generally opposite directions away from the central pedestal 24 adjacent to the upper end 24A of the central pedestal 24. The support beams 26 together make an obtuse angle forwardly of the central pedestal 24. The framework 12 also includes a pair of rigid braces 27 which each has a substantially rectangular transverse configuration. One paired set of support beams 26 and braces 27 are generally disposed on opposite sides of the central pedestal 24 from the other paired set thereof. Each brace 27 is mounted to and extends between the lower end 24B of the central pedestal 24 and the outer end 26B of one of the support beams 26.

Figure 3:
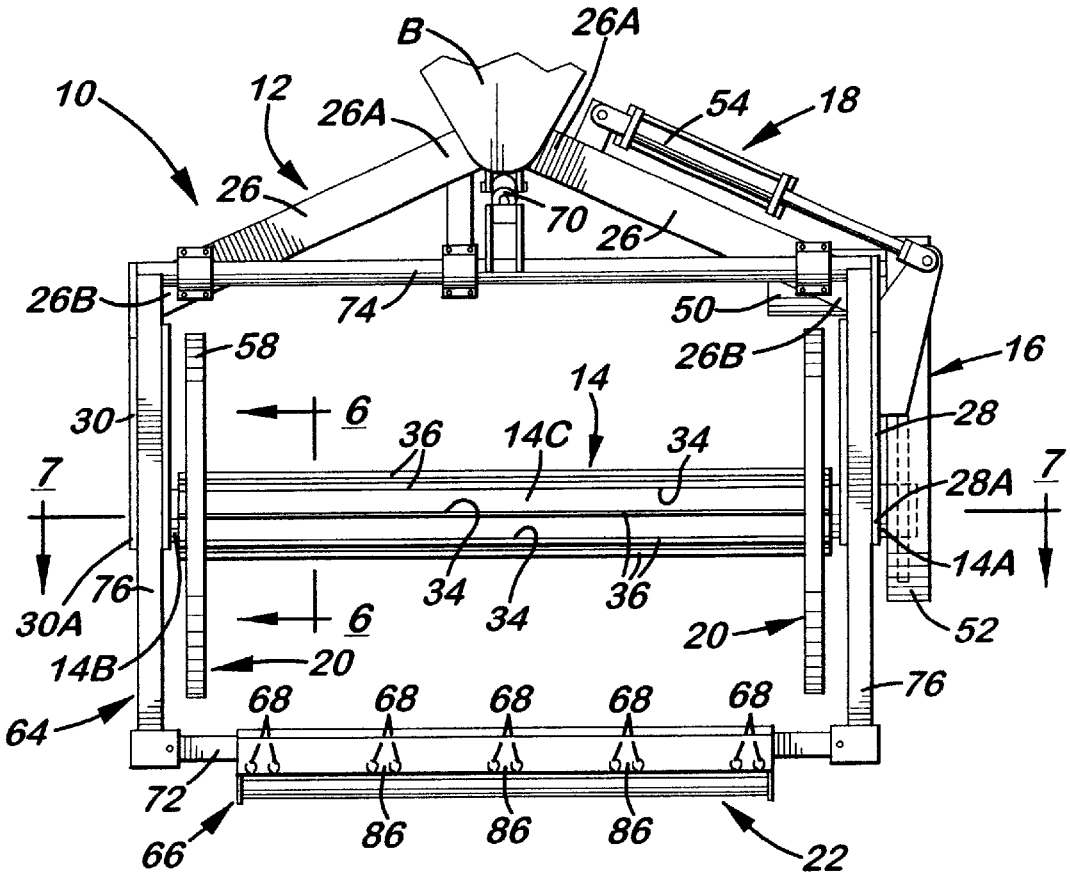
FIG. 3 is a top plan view of the apparatus of FIG. 1.
Figure 9:
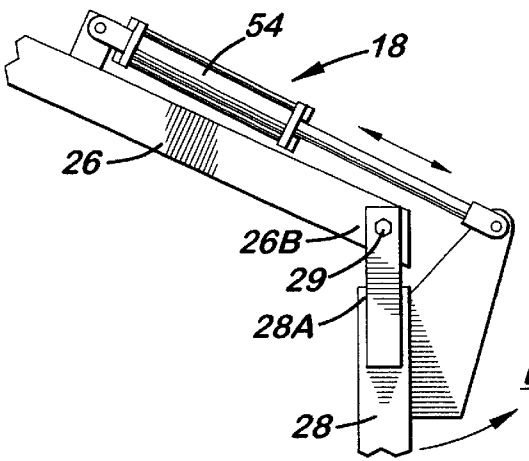
FIG. 9 is a fragmentary top plan view of the apparatus showing an actuator of the apparatus in an extended condition disposing the drum in an operative position relative to the framework of the apparatus.
Figure 10:
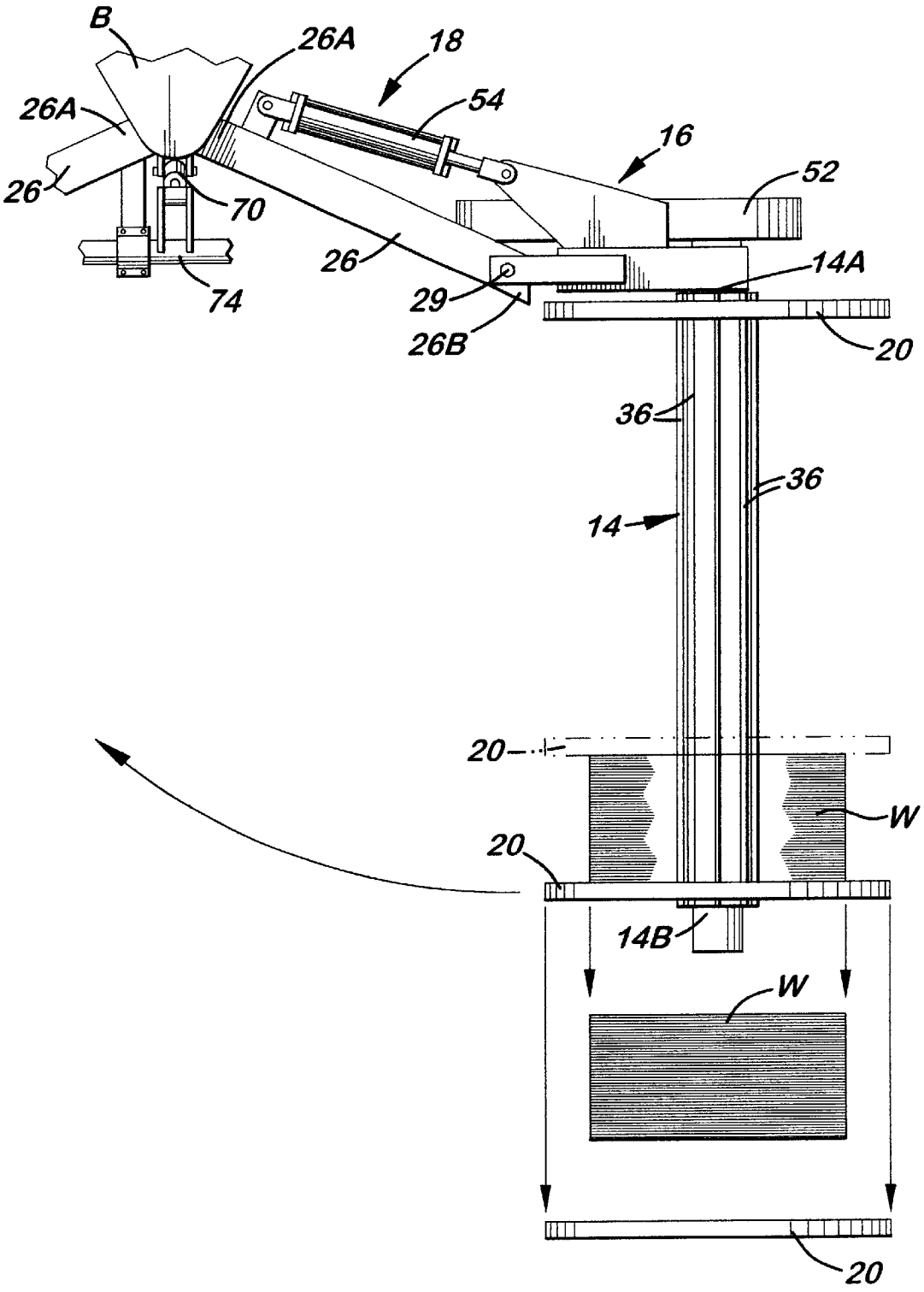
FIG. 10 is a fragmentary top plan view of the apparatus showing the actuator in a retracted condition disposing the drum in an inoperative position relative to the framework of the apparatus.

Referring to FIGS. 9 and 10, the right end portion 28 of the framework 12, as viewed when one is standing in front of the wire guiding arrangement 22 in FIGS. 1 and 3, and facing toward the central pedestal 24 of the framework 12, is pivotally swingably mounted at pivot 29 to the outer end 26B of a right one of the support beams 26. On the other hand, the left end portion 30 of the framework 12 is fixedly and stationarily mounted to the outer end 26B of the left one of the support beams 26 and spaced laterally and oppositely from the pivotally swingably mounted right end portion 28.

The elongated drum 14 has a pair of opposite ends 14A, 14B and is rotatably supported at its opposite ends 14A, 14B by the respective forward ends 28A, 30A of the right and left end portions 28, 30 of the framework 12.

Figure 4:
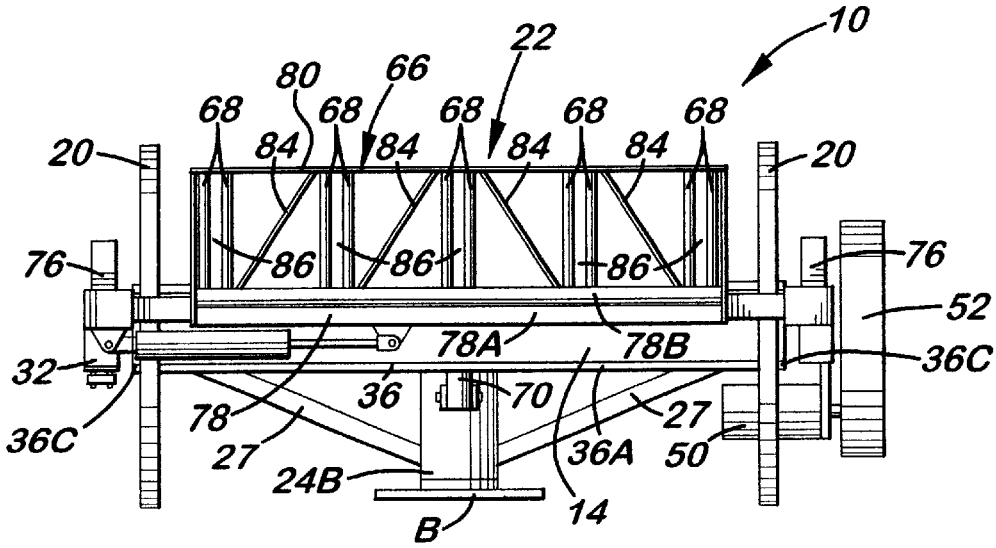
FIG. 4 is a front elevational view of the apparatus of FIG. 1.
Figure 5:
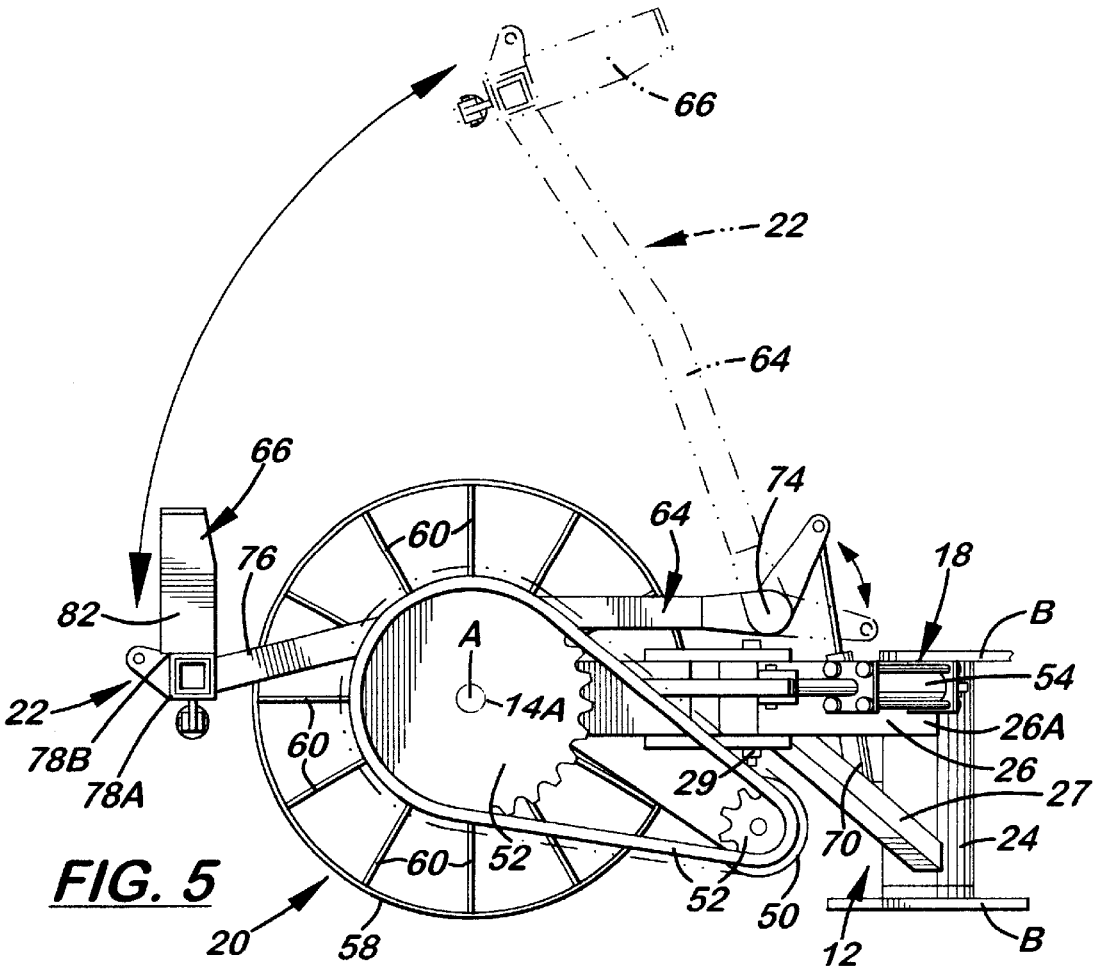
FIG. 5 is a side elevational view of the apparatus as seen along line 5—5 of FIG. 4 showing a barbed wire guide arrangement of the apparatus in a lowered operative position and a raised inoperative position.
Figure 8:
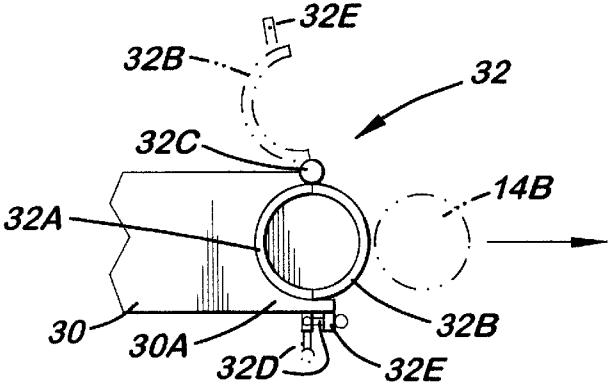
FIG. 8 is an enlarged fragmentary end elevational view of a stationary end portion of a framework of the apparatus of FIGS. 1 and 4 showing a clamp and latch arrangement on the stationary end portion of the framework releasably mounts one end of the drum of the apparatus.

Referring to FIGS. 1, 3, 4 and 8 to 10, the pivotally swingable right end portion 28 of the framework 12 at the forward end 28A thereof securely and rotatably mounts the right end 14A of the drum 14, whereas the fixed or stationary left end portion 30 of the framework 12 at the forward end 30A thereof has a latch mechanism 32 attached thereon which releasably and rotatably mounts the left end 14B of the drum 14. As seen in FIGS. 1, 4 and 8, the latch mechanism 32 has a rear portion 32A fixedly attached on the forward end 30A of the fixed left end portion 30, a front portion 32B pivotally connected at hinge 32C to the fixed rear portion 30A, and a latch 32D pivotally mounted to the fixed rear portion 32A of the latch mechanism 32 opposite from the hinge 32C thereof for engagement with and disengagement from a catch 32E on the pivotal front portion 32B of the latch mechanism 32. Each of the fixed rear portion 32A and the pivotal front portion 32B of the latch mechanism 32 has a substantially C-shaped configuration and together form a continuous cylindrical collar which surrounds and rotatably mounts the left end 14B of the drum 14 when the pivotal front portion 32B is in a latched position relative to the fixed rear portion 32A and the latch 32D engages the catch 32E. When the latch 32D is released from the catch 32E, the pivotal front portion 32B of the latch mechanism 32 is movable between the latched position, as seen in solid line form in FIG. 8 wherein the pivotal front portion 32B is disposed in front of and adjacent to the fixed rear portion 32A, and an unlatched position, as seen in dashed line form in FIG. 8 wherein the pivotal front portion 32B is disposed above the fixed rear portion 32A. In the latched position the latch 32D is pivoted to the solid line horizontal position shown in FIG. 8 wherein it engages the catch 32E, whereas in the unlatched position the latch 32D is pivoted to the dashed line vertical position shown in FIG. 8 wherein it is angularly displaced and disengaged from the catch 32E.

The elongated drum 14 of the apparatus 10 is in the form of an annular hollow tube, preferably of substantially cylindrical configuration, and has a longitudinal central axis A extending between its opposite ends 14A, 14B which are in the form of stub shafts attached to the opposite ends of the hollow tube. The drum 14 further has an outer surface 14C which surrounds the longitudinal central axis A of the drum 14 and extends between the opposite ends 14A, 14B of the drum 14. The drum 14 is securely and rotatably mounted at its right end 14A to the forward end 28A of the pivotal end portion 28 of the framework 12 for undergoing rotation relative thereto and pivotal swinging movement therewith. The drum 14 also is releasably and rotatably mounted at its left end 14B to the forward end 30A of the stationary or fixed end portion 30 of the framework 12 by the latch mechanism 32, as described above. More particularly, the drum 14 is pivotally swingable with the pivotal end portion 28 of the framework 12 about the pivot 29 relative to the support beams 26 of the framework 12 and toward and away from the stationary end portion 30 of the framework 12 so as to dispose the drum 14 in an operative position, as shown in FIGS. 1, 3 and 4, extending between the end portions 28, 30 of the framework 12 wherein the left end 14B of the drum 14 is latched by the latch 32 to the stationary end portion 30 of the framework 12, so as to permit rotation of the drum 14 and the winding or unwinding of wire fence W (FIG. 10) about the drum 14 and in an inoperative position, as shown in FIG. 10, wherein the left end 14B of the drum 14 is released by the latch 32 and angularly displaced away from the stationary end portion 30 of the framework 12 so as to permit loading and unloading of the wire fence W onto and from the drum 14, as depicted in FIG. 10.

Figure 6:
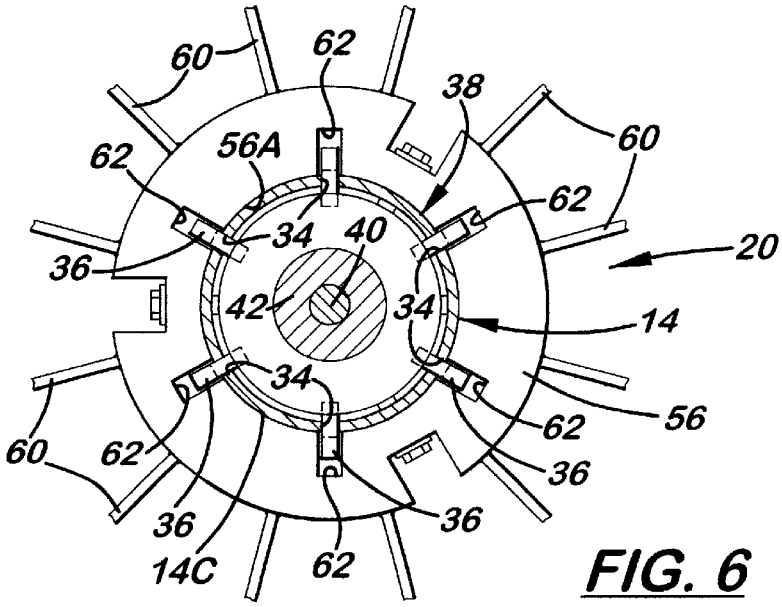
FIG. 6 is a cross-sectional view taken across a rotatable elongated drum of the apparatus along line 6—6 of FIG. 3.

Referring to FIGS. 1, 3 and 6, the drum 14 further has a plurality of elongated slots 34 defined therethrough from the outer surface 14C thereof with each slot 34 extending lengthwise of the drum 14 between the opposite ends 14A, 14B thereof. The slots 34 have substantially rectangular configurations and are circumferentially spaced apart from one another about the drum 14. Furthermore, the slots 34 extend parallel to one another and are disposed radially outwardly from and parallel to the longitudinal central axis A of the drum 14. The apparatus 10 also includes a plurality of elongated or longitudinal bars 36 of generally flat straight configuration. Each of the bars 36 has a substantially rectangular configuration and extends substantially the length of the drum 14. The bars 36 are mounted to the drum 14 so as to undergo radial movement through the slots 34 toward and away from the longitudinal central axis A of the drum 14 between an extended position, as shown in solid line form in FIG. 6, and a retracted position, as shown in dashed line form in FIG. 6. In the extended position, the bars 36 extend outwardly from the outer surface 14C of the drum 14 such that the wire fence W in being wound about the outer surface 14C of the drum 14 is wound on outer edges 36A of the bars 36 and thus spaced outwardly from the outer surface 14C of the drum 14. In the retracted position, the bars 36 are disposed inwardly toward the outer surface 14C of the drum 14 such that the outer edges 36A of the bars 36 are closer to the outer surface 14C of the drum 14 than when at the extended position and thus the wire fence W wound about the outer surface 14C can readily be slidably removed from the left end 14B of the drum 14, as depicted in FIG. 10.

Figure 7:
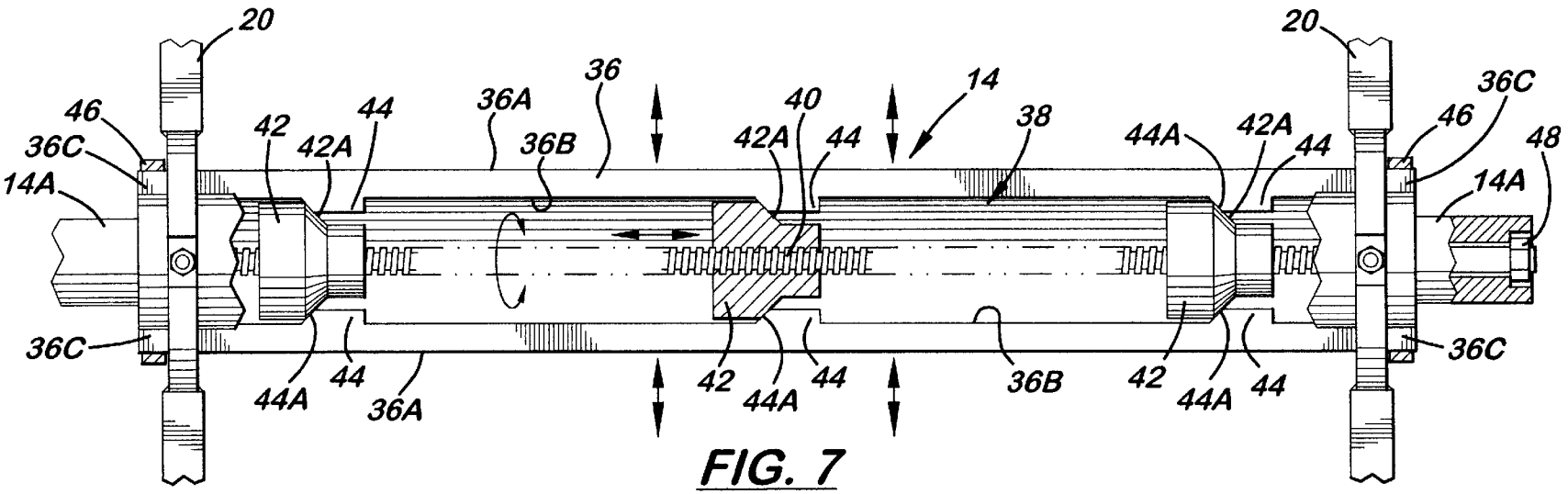
FIG. 7 is an enlarged longitudinal sectional view taken axially through the drum of the apparatus along line 7—7 of FIG. 3.

Referring to FIGS. 6 and 7, the apparatus 10 also includes means 38 for causing radial movement of the bars 36 relative to the drum 14 between the extended and retracted positions. The radial movement causing means 38 includes a drive screw 40, a plurality of annular-shaped cam collars 42, a plurality of cam followers 44 attached on an inner edge 36B of each of the bars 36, a biasing means 46, such as annular bands of elastic material, encircling the opposite ends 36C of the bars 36, and a drive screw rotation means 48. The drive screw 40 is externally threaded, extends through the hollow drum 14 and is rotatably mounted to the opposite ends 14A, 14B of the drum 14. The drive screw 40 extends along the longitudinal central axis A and through substantially the length of the drum 14. The cam collar 42 is internally threaded. The cam collar 42 is disposed in surrounding relationship around and threadably engaged with the drive screw 40 for undergoing movement therealong in opposite directions upon rotation of the drive screw 40 in opposite directions. The cam collars 42 have respective annular-shaped inclined cam surfaces 42A which extend around the drive screw and the cam followers 44 have respective inclined cam surfaces 44A which are engageable with the respective annular-shaped inclined cam surfaces of the cam collars 42 such that rotation of the screw 40 in one or the other of the opposite angular directions causes movement of the cam collars 42 in one or the other of opposite axial directions and thereby radial movement of the bars 36 between the radially extended and retracted positions. The elastic bands 46 bias the bars 36 toward the radially retracted position such that axial movement of the cam collars 42 away from the cam followers 44 allows the stretched bands 46 to return the bars to the retracted positions. In an exemplary form, the drive screw rotation means 48 can be a lug 48 on the end of the drive screw 40 at the left end 14B of the drum 14 which can be manually engaged and turned by use of a wrench to cause rotation of the drive screw 40 in opposite directions.

The drum rotation means 16 for causing rotation of the drum 14 about the longitudinal central axis A thereof for winding or unwinding the wire fence W about the outer surface 14C of the drum 14 includes a motor 50 supported on the pivotal end portion 28 of the framework 12 and a drive train 52 movable coupling the motor 50 to the right end 14A of the drum 14 such that operation of the motor 50 in a selected one of two opposite directions causes rotation of the drum 14 in a corresponding one of two opposite directions about the longitudinal central axis A of the drum 14. The drum pivotal movement means 18 for causing pivotal movement of the drum 14 relative to the framework 12 between the operative and inoperative positions as shown respectively in FIGS. 3 and 10, is an actuator 54 connected between and to the pivotal end portion 28 and the right one of the support beams 26 of the framework 12. The actuator 54, which can be a hydraulic cylinder, is extendible and retractable for pivotally swingably moving the pivotal end portion 28 of the framework 12 and the drum 14 between the operative position and the inoperative position when the latch mechanism 32 is at its unlatched position, as described above.

Referring to FIGS. 1, 3 to 6 and 10, the guide plates 20 of the apparatus 10 are mounted to the drum 14 and are spaced apart from one another along the longitudinal central axis A of the drum 14 so as to define a region on the drum 14 between the guide plates 20 about which the wire fence W can be wound and unwound about the surface 14C of the drum 14. The guide plates 20 are substantially identical to one another. Each guide plate 20 has a substantially wagon-wheel-like configuration. Each guide plate 20 has an inner hub 56, an outer rim 58 and a plurality of spokes 60. The inner hub 56 is slidably mounted adjacent to one of the ends 14A, 14B of the drum 14 and has a series of circumferentially spaced notches 62 defined into the inner edge 56A of the inner hub 56 to accommodate the presence of the bars 36. The outer rim 58 is radially spaced from and concentric with the inner hub 56. The spokes 60 are circumferentially spaced apart from one another relative to the inner hub 56 and are mounted to and radially extend between the inner hub 56 and the outer rim 58.

Referring to FIGS. 1 and 3 to 5, the wire guiding arrangement 22 of the apparatus 10 includes a support bracket 64, a mounting bracket 66, a plurality of vertical rollers 68 supported by the mounting bracket 66, and an actuator 70. The support bracket 64 has a rectangular configuration and is formed by a forward member 72, a rearward member 74 and a pair of opposite end members 76. The opposite end members 76 extend between and rigidly interconnect the forward and rearward members 72, 74. Each of the forward member 72 and the opposite end members 76 has a substantially rectangular transverse configuration. The forward member 72 has a substantially straight longitudinal configuration. Each of the opposite end members 76 is bent at an intermediate position thereof such that obtuse angles are formed facing downwardly toward the drum 14 when the drum 14 is in the operative position. The opposite end members 76 extend past the outer sides of the guide plates 20 which are disposed between the forward and rearward members 72, 74 and between the opposite end members 76. The rearward member 74 has a substantially cylindrical and straight longitudinal configuration and is rotatably or pivotally mounted to the support beams 26 of the framework 12 such that the opposite end members 76 extend above and forwardly of the drum 14 to the forward member 72.

The mounting bracket 66 of the wire guiding arrangement 22 includes a lower member 78, an upper member 80, opposite end members 82 and a plurality of intermediate braces 84. The lower member 78 has a tubular portion 78A and a bar portion 78B. The tubular portion 78A of the lower member 78 has a substantially rectangular transverse configuration and a substantially straight longitudinal configuration. The tubular portion 78A of the lower member 78 also has opposite open ends and receives therethrough and is mounted to the forward member 72 of the support bracket 64. The bar portion 78B of the lower member 78 has a substantially cylindrical and straight longitudinal configuration and is disposed in substantially parallel relation to the tubular portion 78A of the lower member 78. The opposite end members 82 and the intermediate braces 84 extend between and rigidly interconnect the lower and upper members 78, 80. The vertical rollers 68 of the guide arrangement 22 extend between and are mounted to the lower and upper members 78, 80 of the mounting bracket 66 and are thereby mounted upon the forward member 72 of the support bracket 64 of the wire guiding arrangement 22. The intermediate braces 84 are interspersed between the vertical rollers 68 of the wire guiding arrangement 22. The vertical rollers 68 of the wire guide arrangement 22 are spaced apart from one another so as to define spaces 86 therebetween through which individual strands of barbed wire fence are guided to the drum 14. The actuator 70 of the wire guiding arrangement 22 is connected between and to the central pedestal 24 of the framework 12 and the rearward member 74 of the support bracket 64. The actuator 70 is extendible and retractable for moving the support bracket 64 between a raised inoperative position, as seen in dashed line form in FIG. 5, and a lowered operative position, as seen in solid line form in FIG. 5. When the support bracket 64 is in the raised inoperative position, the wire fence may be removed from or loaded onto the drum 14. When the support bracket 64 is in the lowered operative position, the individual strands of wire fence may be wound about or unwound-from the drum 14.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A wire fence roller apparatus, comprising:

(a) a framework adapted for mounting on a movable carrier, said framework including a pivotal end portion, a stationary end portion and a support structure having opposite ends, said pivotal end portion being pivotally swingably mounted to one of said opposite ends of said support structure, said stationary end portion being stationarily mounted to the other of said opposite ends of said support structure and spaced laterally and opposite from said pivotal end portion;

(b) an elongated drum having a pair of opposite ends, a longitudinal central axis extending between said opposite ends and an outer surface surrounding and spaced radially outwardly from said longitudinal central axis and extending between said opposite ends, said drum at one of said opposite ends of said drum being securely and rotatably mounted to said pivotal end portion of said framework and at the other of said opposite ends of said drum being releasably and rotatably latched to said stationary end portion of said framework such that said drum is pivotally swingable with said pivotal end portion of said framework relative to said support structure of said framework and toward and away from said stationary end portion and support structure of said framework so as to dispose said drum in an operative position wherein said drum extends between said pivotal and stationary end portions of said framework and said other of said opposite ends of said drum is rotatably latched to said stationary end portion of said framework to permit rotation of said drum and winding or unwinding of the wire fence about or from said drum and in an inoperative position wherein said other of said opposite ends of said drum is released from said stationary end portion of said framework and with said pivotal end portion of said framework is pivoted and angularly displaced away from said stationary end portion and said support structure of said framework to permit loading and unloading of the wire fence onto and from said drum;

(c) means for causing rotation of said drum about said longitudinal central axis thereof for winding or unwinding wire fence about or from said outer surface of said drum;

(d) means for causing pivotal movement of said drum with said pivotal end portion of said framework relative to said stationary end portion and said support structure of said framework for disposing said drum in said respective operative and inoperative positions; and (e) a wire guiding arrangement including (i) a support bracket having forward and rearward members and opposite end members extending between and rigidly interconnecting said forward and rearward members, said rearward member of said support bracket being rotatably mounted to said framework rearwardly of said drum such that said opposite end members of said support bracket extend above and forwardly of said drum to said forward member of said support bracket and said support bracket is movable between a raised inoperative position and a lowered operative position, (ii) a plurality of vertical rollers mounted upon said forward member of said support bracket and laterally spaced apart from one another so as to define spaces therebetween through which individual strands of barbed wire fence are guided to said drum for winding or unwinding the barbed wire fence about or from said outer surface of said drum when said drum is in said operative position and said support bracket is at said lowered operative position; and (iii) an actuator connected between and to said framework and said rearward member of said support bracket and being extendible and retractable for moving said support bracket between said raised inoperative position and said lowered operative position.

2. The apparatus of claim 1 wherein said framework has a substantially U-shaped configuration.

3. The apparatus of claim 1 wherein said support structure of said framework includes a pair of support beams each having a pair of opposite ends, said support beams being interconnected at adjacent ones of said opposite ends thereof to the movable carrier.

4. The apparatus of claim 3 wherein said framework further includes a central pedestal for mounting said framework to the movable carrier, said support beams being fixedly attached at said same ends thereof to and extending in generally opposite directions from said central pedestal.

5. The apparatus of claim 1 further comprising:

a pair of guide plates mounted to said drum and spaced apart from one another along said longitudinal central axis of said drum so as to define a region on said drum between said guide plates at which the wire fence can be wound and unwound about said outer surface of said drum.

6. The apparatus of claim 1 wherein said means for causing pivotal movement of said drum with said pivotal end portion of said framework relative to said support structure and stationary end portion of said framework includes an actuator connected between and to said pivotal end portion of said framework and said support structure of said framework and being extendible and retractable for pivotally swingably moving said pivotal end portion of said framework and said drum therewith between said operative position and said inoperative position.

7. The apparatus of claim 1 wherein said means for causing rotation of said drum includes a motor mounted to said pivotal end portion of said framework and a drive train movably coupling said motor to said one end of said drum such that operation of said motor causes rotation of said drum.

8. The apparatus of claim 1 wherein said drum is hollow and has a plurality of slots defined therethrough from said outer surface thereof and being circumferentially spaced apart from one another and extending generally parallel to one another and to said longitudinal central axis of said drum between said opposite ends thereof.

9. The apparatus of claim 8 further comprising:

a plurality of elongated bars mounted to said drum for undergoing radial movement toward and away from said longitudinal central axis of said drum through said slots in said outer surface of said drum between an extended position wherein outer edges of said bars are disposed outwardly from said outer surface of said drum such that the wire fence in being wounded about said outer surface of said drum is wound on said outer edges of said bars and thus spaced outwardly from said outer surface and a retracted position wherein said outer edges of said bars are disposed closer to said outer surface of said drum than when at said extended position such that the wire fence wound about said outer surface of said drum can be slidably removed from said other of said opposite ends of said drum.

10. The apparatus of claim 9 further comprising:

means for causing radial movement of said bars relative to said drum between said extended and retracted positions.

11. The apparatus of claim 10 wherein said. means for causing radial movement of said bars includes:

an externally threaded drive screw rotatably mounted to said drum and extending through said drum and along said longitudinal central axis of said drum;

at least one internally threaded cam collar disposed in said drum and around and threadably engaged with said drive screw for undergoing movement therealong in opposite directions upon rotation of said drive screw in opposite directions;

a plurality of cam followers each attached to one of said bars and engaged with said cam collar such that each of said bars is radially movable between said retracted and extended positions in response to rotation of said drive screw in one or the other of the opposite directions which causes movement of said cam collar in one or the other of opposite directions along said longitudinal central axis of said drum;

means for biasing each of said bars to said retracted position; and means for causing rotation of said drive screw in said opposite directions.

* * * * *